US006063160A

United States Patent [19]

Krogerus et al.

[11] Patent Number: 6,063,160

[45] Date of Patent: May 16, 2000

[54] METHOD FOR SINTERING FINELY DIVIDED MATERIAL

[75] Inventors: Helge Krogerus, Pori; Jorma Daavittila; Païvi Oikarinen, both of Espoo, all of Finland

[73] Assignee: Outokumpu Oyj, Finland

[21] Appl. No.: 09/047,707

[22] Filed: Mar. 25, 1998

[30] Foreign Application Priority Data

Apr. 10, 1997 [FI] Finland ..... 971483

[51] Int. Cl.[7] ..... C22B 1/16

[52] U.S. Cl. ..... 75/757; 75/759; 264/652; 264/656; 264/658; 264/660; 423/49

[58] Field of Search ..... 264/652, 658, 264/656, 660, 661; 423/49; 75/757, 759

[56] References Cited

U.S. PATENT DOCUMENTS 4,010,236 3/1977 Welsh ..... 423/49
5,270,022 12/1993 Kothari ..... 423/49

FOREIGN PATENT DOCUMENTS 1429299 1/1966 France ..... 264/652
2556826 6/1985 France ..... 264/652

*Primary Examiner*—James Derrington
*Attorney, Agent, or Firm*—Morgan & Finnegan, LLP

[57] ABSTRACT

The invention relates to a method and apparatus for sintering finely divided material, containing manganese compounds with a particle size less than 6 mm and a high degree of oxidation, by means of some carbon-bearing material in a conveyor-type sintering apparatus (9) in an essentially continuous operation. According to the invention, through the material (8) to be sintered in the sintering apparatus (9), there is conducted hot gas (15, 18), which causes combustion reactions between the manganese compounds contained in the material and having a high degree of oxidation and the carbon contained in the burning material. Thus the sintering (18) is carried out essentially by means of the combustion heat released from the material (8). Moreover, the sintered material (8) is subjected to cooling (17) prior to removing the material from the sintering apparatus (9).

6 Claims, 1 Drawing Sheet

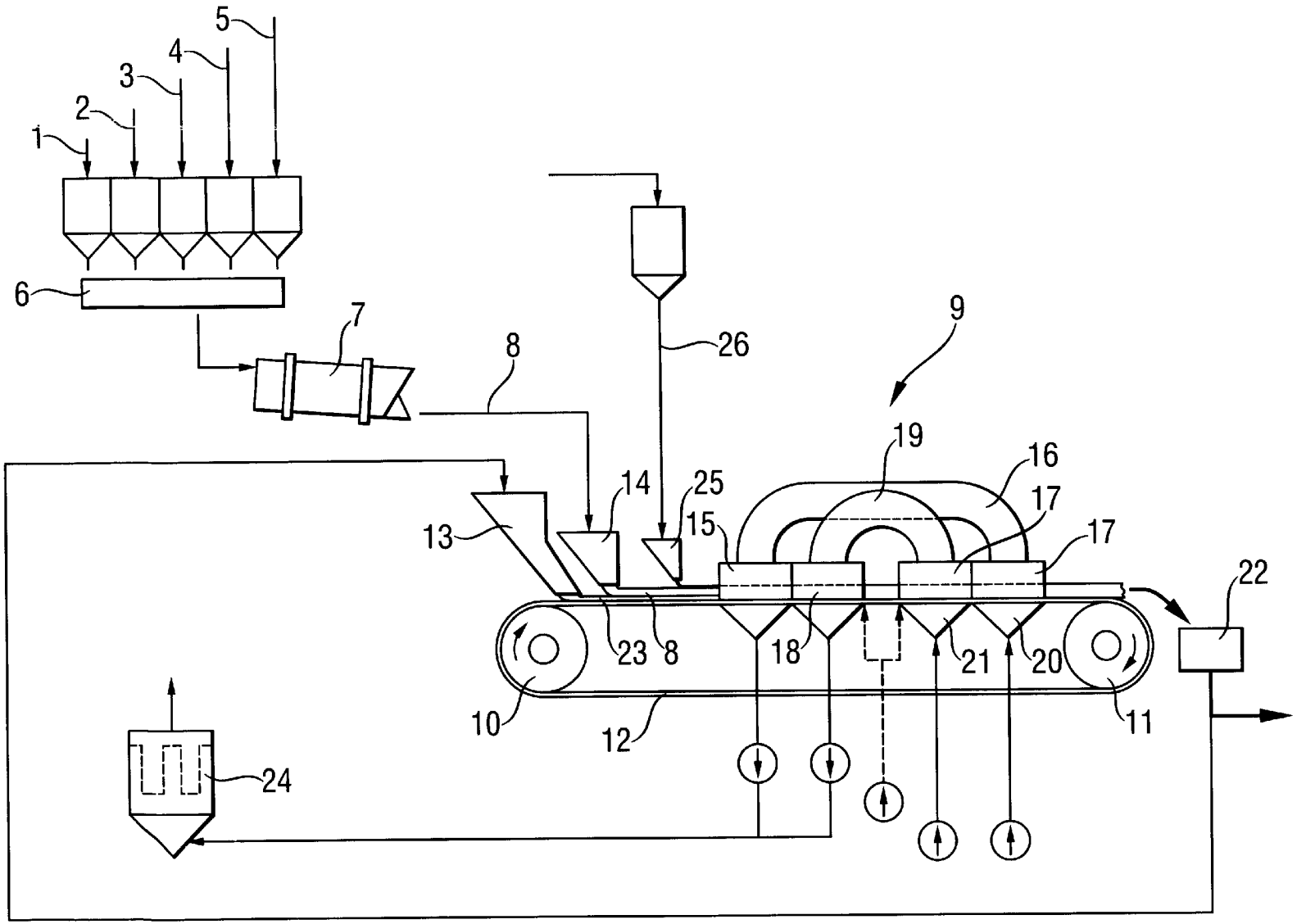
1
2
3
4
5
6
7
8
8
9
10
11
12
13
14
15
16
17
17
18
19
20
21
22
23
24
25
26

METHOD FOR SINTERING FINELY DIVIDED MATERIAL

The present invention relates to a method and apparatus for sintering finely divided, manganese-bearing material in a conveyor-type sintering apparatus by making use of the combustion heat of the manganese compounds that are contained in the material and have a high degree of oxidation.

In connection with the mining and crushing of manganese ore, there are obtained remarkable amounts of finely divided ore with a particle size of less than 6 mm. Nowadays this finely divided ore is utilised only partly, while the major part of said ore is in storage. Finely divided ore cannot be used to any significant amount in ore smelting, because the finely divided material easily causes the formation of a solid crust in the top part of the melt in the material bed of the electric furnace that is widely used in smelting. The formation of said crust prevents an even settling of the batch to be fed into the smelting furnace and creates a channelling of the reduction gases created in the smelting process.

Finely divided manganese ore is generally sintered in a furnace provided with a moving grate, or on an open grate-type steel band or batchwise in a pan sintering machine. The grate furnace that was mentioned first is complicated in structure and requires high maintenance costs. In addition, this type of grate furnace is economical only with very large capacities. When sintering the material bed on an open grate-type steel band, the temperature adjusting of said material bed is not very precise, because the air of the hall surrounding the steel band is sucked directly through the material bed. In pan sintering, the sintering capacity remains low, and the quality of the obtained sintering product is non-homogeneous.

The object of the present invention is to eliminate some of the drawbacks of the prior art and to achieve an improved and more energy-efficient method and apparatus for sintering finely divided, manganese-bearing materials by means of some carbon-bearing material, by making use of the combustion heat of the manganese compounds contained in the material and having a high degree of oxidation. The essential novel features of the invention are apparent from the appended claims.

According to the invention, the finely divided manganese-bearing material that is meant to be sintered is first pretreated in order to carry out the sintering in an advantageous fashion. In this pretreatment, in the finely divided manganese-bearing material, there is added some binding agent and, if necessary, some burning material. The obtained mixture is micropelletized, whereafter the material is ready to be sintered. The pretreated material meant to be sintered according to the invention is fed into a conveyor-type sintering apparatus as an essentially even material bed in order to carry out sintering essentially in continuous operation. According to the invention, the conveyor-type sintering apparatus is advantageously provided with separate zones for the drying and sintering of the material to be sintered and for the cooling of the sintered product. The sintered material obtained from the cooling zone is preferably conducted further, for instance to crushing, in order to adjust the particle size of the material so as to be suitable in the smelting furnace. The finely divided material created in crushing is advantageously returned to the pretreatment step of the sintering process.

When treating manganese-bearing material according to the invention, the material bed to be fed onto a conveyor-type sintering apparatus is advantageously composed of two parts. Onto the conveyor surface of the sintering apparatus, there is fed the already sintered and crushed, bed-like layer that advantageously consists of one and the same material. The purpose of this bed that serves as the bottom layer is to protect the conveyor surface used for transferring the material from any sticking of said material. Onto the bottom layer, there is then fed the manganese-bearing material bed proper which is meant to be sintered. At least part of the required burning material can be added onto the surface of the material to be sintered that was already fed onto the conveyor surface.

In the apparatus according to the invention, the conveyor surface used for transferring the material to be sintered is provided with gas flow apertures that are arranged in the moving direction of the conveyor surface and spaced apart, so that gas flow apertures are arranged in the conveyor surface along the whole length thereof. In relation to each other, the gas flow apertures are located so that they are spaced apart also in the transversal direction of the conveyor surface. Thus, when treating the material according to the invention, the gases can advantageously be conducted through the material bed under treatment.

In the conveyor-type sintering machine according to the invention, around the sintering belt serving as the conveyor surface of the material conveying member, in the immediate vicinity of the sintering belt, there are installed gas ducts for conducting the gases used in the sintering process advantageously from one zone to another in order to create zones that are different in temperature. Said gas ducts are advantageously installed so that the gases circulated in the process are first brought to the cooling zone. The cooling zone is divided, by means of the gas ducts, to at least two parts, so that part of the gases are conducted, via gas flow apertures provided on the material conveyor surface through the hot, sintered material, and part of the gases are conducted, via the gas flow apertures provided on the material conveyor surface, through the sintered material already cooled in the other gas part. The gases coming from the hotter part of the cooling zone, i.e. from the first part of the cooling zone, are conducted, by means of a gas duct, further to a reaction zone, where the material sintering proper takes place. From the end part of the cooling zone, where the temperature of the emitted gases is lower than that of the gases coming form the first part of the cooling zone, the gases are conducted, by means of a gas duct, to a colder drying and preheating zone that precedes the hot reaction zone. The gases coming from the reaction zone and from the drying and preheating zone are conducted to gas cleaning and cooling, from where they can advantageously be returned to the sintering apparatus.

In conveyor-type sintering apparatus, the manganese-bearing material to be sintered first passes through the drying and preheating zone, where through the material bed, there are circulated gases obtained from the final cooling of the already sintered material. In the drying and preheating zone, the material is advantageously dried only in part, which helps the material bed to stay together prior to passing over to the reaction zone.

According to the invention, through the manganese-bearing material bed to be sintered in the reaction zone, there is circulated gas obtained from the preliminary cooling of the already sintered material. The temperature of said gas is within the range of 700–800° C., in which case the material bed is heated rapidly. In connection with the heating, oxygen contained in the manganese compounds is released from the manganese-bearing material bed, and this oxygen reacts vigorously with the carbon-bearing burning material contained in the material or added thereto. Owing to the exothermic reactions caused by the oxygen, the temperature of the material bed is rapidly raised up to the sintering temperature, to the temperature range 1350–1450° C. As a result of the achieved high temperature, the material bed to be sintered is partly smelted, and in the bed, there are formed gas channels and a partial porous structure by means of the reaction g as and the gases released from the bed. Moreover, in the reaction zone there are also carried out reduction processes owing to the effects of the carbon contained in the material and the carbon monoxide created in said reactions, and these reduction processes affect both the manganese compounds and the iron oxides contained in the material.

In the conveyor-type sintering apparatus according to the invention, the material bed coming from the reaction zone proceeds to the cooling zone. The cooling is advantageously carried out in two stages. In the beginning of the cooling zone, through the material bed there is conducted gas that is further circulated to the reaction zone. The gas to be used in the end part of the cooling zone is conducted through the sintered material bed, and further to the drying and preheating zone of the sintering apparatus according to the invention In the cooling zone the sintered material bed is cooled down to a temperature suitable for further processing. At the same time, the structure of the sintered material bed is advantageously solidified.

The method and apparatus according to the invention for manufacturing a sintered product can be applied for several manganese-containing materials. Such materials are for instance oxide and carbon-bearing manganese materials. Moreover, according to the invention it is possible to use less of such manganese materials that have a high degree of oxidation. On the basis of the degree of oxidation of manganese, for example the quantity of burning material to be added in the material can be advantageously determined.

When treating manganese-bearing material according to the method of the invention, prior to the high-temperature treatment, there is added some binding agent and, when necessary, some burning material in the material. The employed binding agent is bentonite or some other material of the same type, so that the binding agent quantity is advantageously about 1% by weight of the material to be sintered. The employed burning material is coke, charcoal or some other material of the same type, so that the burning material quantity is advantageously 6–9% by weight of the material to be sintered.

The invention is explained in more detail below, with reference to the appended drawing which represents a flowchart of a preferred embodiment of the invention.

According to the drawing, the finely divided, manganese-bearing material 1 to be treated, the bentonite 2 operating as the binding agent, the coke 3 operating as the burning material, the finely divided circulating material 4 of the method and the circulating dust 5 are mixed in a mixing apparatus 6, and the obtained mixture is conducted to micropelletizing 7. The obtained, pretreated material 8 is conducted to a conveyor-type sintering apparatus 9, where the material under treatment is transferred by means of a sintering belt 12 which is arranged to rotate around the transmission and bending drums 10 and 11.

Onto the sintering belt 12, to its first end when seen in the moving direction, there is first fed, through a feeding member 13, a layer of already sintered product to form a bed-like bottom layer 23. On top of said bed-like bottom layer, at its first end when seen in the moving direction of the sintering belt 12, there is fed the material proper 8 to be treated via a feeding member 14. Part of the burning material 26 needed in sintering is fed, through a feeding device 25, onto the material 8 to be treated. The material 8 to be treated that is located on the sintering belt 12 is first passed to the drying and preheating zone 15, where the drying and preheating are carried out by means of gas emitted from the latter end of the cooling zone 17 via a gas duct 16. The sintering of the material 8 is carried out in the reaction zone 18, where the gas coming from the first end of the cooling zone 17 is circulated via the gas duct 19. Owing to hot gases, within the temperature range 700–800° C., oxygen contained in the manganese compounds begins to be released from the material bed 8, and this oxygen reacts vigorously with the carbon-bearing burning material contained in the material. Now the material temperature rises up to the sintering temperature, to the temperature range 1350–1450° C. After sintering, the material proceeds to a two-stage cooling zone 17, where the cooling is carried out by means of gases coming via gas ducts 20 and 21. The gas coming from the gas duct 20 is further conducted to the gas duct 16, and the gas coming from the gas duct 21 is conducted to the gas duct 19. The sintered material obtained from the cooling zone 17 is advantageously processed further, for instance by crushing in a crusher 22. Part of the sintered material is recirculated to the sintering apparatus 9 via the feeding member 13, to recreate the bed-like bottom layer 23 for the new material to be sintered. The gases discharged from the sintering zone 18 and from the drying and preheating zone 15 are conducted to gas cleaning 24, wherefrom they can, if desired, be recirculated back to the sintering process.

We claim:

1. A method of sintering finely divided manganese-containing material having a particle size smaller than 6 mm by means of a carbon-bearing material which comprises adding a binding agent and, optionally, additional carbon-bearing material to said finely divided material, micropelletizing said resulting mixture, passing the micropelletized composition through a first zone wherein the micropelletized composition is at least partially dried and preheated, then passing the preheated composition through a reaction and sintering zone, and subsequently passing the reacted sintered material through a cooling zone, wherein the gases emanating from the cooling zone are recirculated to the first zone to preheat the composition in the first zone, and the heat of the reaction between the manganese-containing material and the burning material in the second reaction zone is used to obtain the sintering temperature in said reaction zone, and carrying out the sintering operation essentially continuously on a conveyor surface.

2. A method as defined in claim 1, wherein gas is passed through each of the three zones.

3. A method as defined in claim 1, wherein the cooling zone comprises at least two stages.

4. A method as defined in claim 2 wherein the gas introduced into the first or preheating zone and the reaction and sintering zone is gas emanating from the cooling zone.

5. A method as defined in claim 1 wherein said manganese-containing material contains manganese oxide.

6. A method as defined in claim 1 wherein said binding agent is bentonite.

* * * * *